US007530456B1

(12) United States Patent
Tsai

(10) Patent No.: US 7,530,456 B1
(45) Date of Patent: May 12, 2009

(54) SAFETY ENHANCED PISTOL HOLDER

(75) Inventor: Ying Chun Tsai, Taipei (TW)

(73) Assignee: Steady Flying Enterprise Co., Ltd., Taipei (TW)

( * ) Notice: Subject to any disclaimer, the term of this patent is extended or adjusted under 35 U.S.C. 154(b) by 11 days.

(21) Appl. No.: 11/926,511

(22) Filed: Oct. 29, 2007

(51) Int. Cl.
*B65D 85/00* (2006.01)
*F41C 33/02* (2006.01)

(52) U.S. Cl. ..... 206/317; 70/63; 244/243; 244/244; 244/912

(58) Field of Classification Search ..... 206/1.5, 206/3, 317; 42/70.01–70.11; 70/63; 109/45, 109/47; 211/4, 64; 224/193, 242–244, 911, 224/912; 312/242
See application file for complete search history.

(56) References Cited

U.S. PATENT DOCUMENTS 5,168,994 A * 12/1992 Beletsky et al. ..... 206/317
5,518,155 A * 5/1996 Gallagher ..... 224/244
5,544,794 A * 8/1996 Nichols ..... 224/912
5,621,996 A * 4/1997 Mowl, Jr. ..... 42/70.07
6,230,946 B1 * 5/2001 Vor Keller et al. ..... 224/244
2003/0042279 A1 * 3/2003 Locklear, III ..... 224/244
2003/0141331 A1 * 7/2003 Liu ..... 224/244
2005/0035163 A1 * 2/2005 French et al. ..... 224/243
2008/0142556 A1 * 6/2008 Fan ..... 224/243

* cited by examiner

*Primary Examiner*—Luan K Bui
(74) *Attorney, Agent, or Firm*—Lowe Hauptman Ham & Berner, LLP

(57) ABSTRACT

A safety enhanced pistol holder is provided, it has double security mechanism which consists of a locking mechanism and a safety enhanced mechanism. The locking mechanism consists mainly a braker having the function as a hook, it locks onto pistol when pistol is put into the pistol holder. The safety enhanced mechanism has a button and pin which inserts through a side hole of said braker so to prevent the braker from moving. By locking the pistol and secure the lock, pistol can be safely kept in the pistol holder from voluntary robbery and involuntary fall out. In order to pull out pistol, the user must push the button of said safety enhanced mechanism to a position of unlocking the locking mechanism, and press the pistol down to release the locking mechanism for pulling the pistol out of pistol holder.

4 Claims, 7 Drawing Sheets

SAFETY ENHANCED PISTOL HOLDER

BACKGROUND OF INVENTION

1. Field of the Invention

The present invention relates to a safety enhanced pistol holder, particularly to a pistol holder having the function of locking the pistol by a locking mechanism of the pistol holder, when it is necessary to take out the pistol, the pistol must first be pressed downward before it is pulled out, and there is a safety enhancement mechanism that locks the said lock mechanism to prevent the pistol from being pulled out by other people.

2. Description of the Prior Art

As it is publicly known, conventional pistols used in military and police department are hold by a pistol holder that hangs down near user's upper leg, this kind of pistol holder has only a belt for security, as a result, lawbreaker only need to untie the belt or taking away the pistol directly from the pistol holder, which is a dangerous design.

SUMMARY OF INVENTION

In view of the above-mentioned disadvantages happened in conventional pistol holder, the inventor of the present invention herein conducted intensive research based on many years of experience obtained through professional engagement in the manufacturing of related products with continuous experimentation and improvement culminating in the development of the improved mechanism of the safety enhanced pistol holder which will be elucidated hereinafter.

Therefore, it is the main object of present invention to provide a safety enhanced pistol holder, which can automatically locks pistol after the pistol is put into the holder, so to prevent robbery or unintentional fall out.

In order to achieve the main object of present invention, there is provided a safety enhanced pistol holder that after the pistol is put and locked in the holder, it is required to press down the pistol to deactivate the lock mechanism, and then the pistol cannot be easily pulled out of the pistol holder by lawbreaker or someone else.

Another object of present invention is to provide a safety enhanced pistol holder having a safety pin to control and stop the movement of said lock mechanism in the pistol holder, such that a further safety protection is assured.

A more complete understanding of these and other features and advantages of the present invention will become apparent from a careful consideration of the following detailed description of certain embodiments illustrated in the accompanying drawings.

DETAILED DESCRIPTION OF PREFERRED EMBODIMENTS

Figure 1:
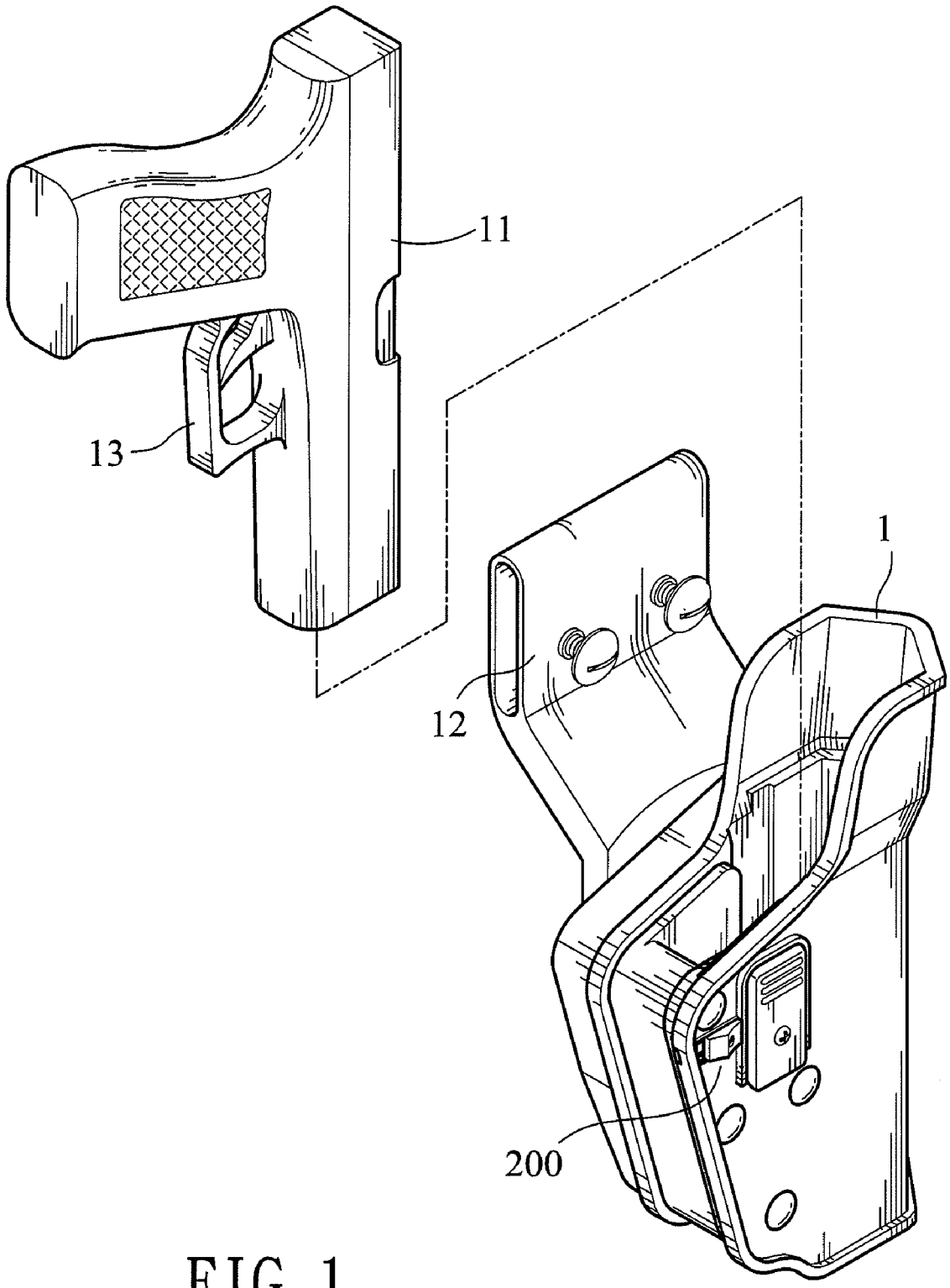
FIG. 1 is a perspective view showing a pistol and the pistol holder of present invention.

As shown in FIG. 1, the pistol holder of present invention, is composed with pistol holding member 1 for pistol 11 to put in and a small belt loop 12 formed on one side of the pistol holding member, so that when in use, a fastening belt can penetrate through the belt loop 12, and then fasten the pistol holding member 11 onto the outside of user's body, and then make easy for user to put in or take out the pistol.

Figure 2:
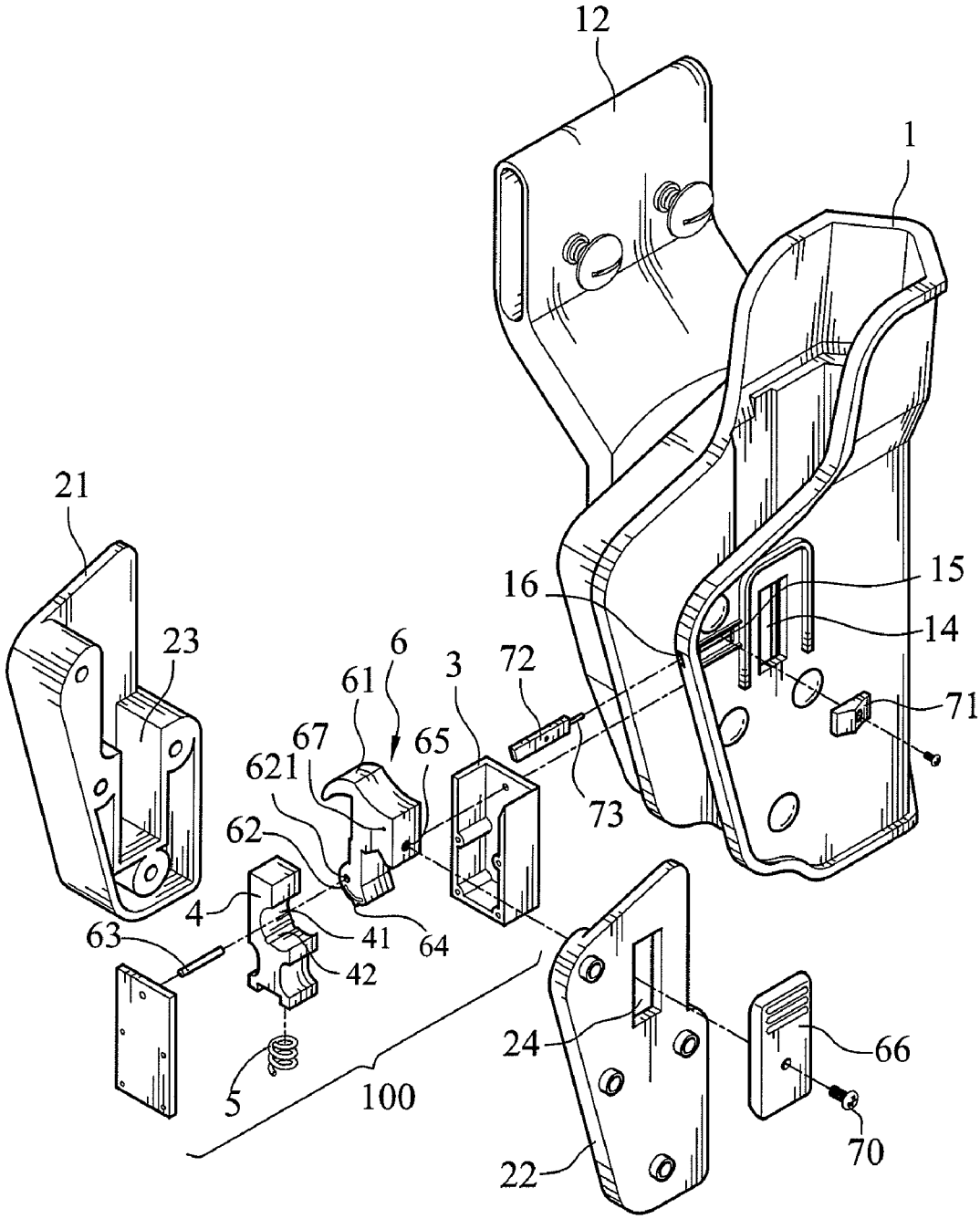
FIG. 2 is an exploded perspective view showing the constructional elements of present invention.

Please refer to FIG. 2, it is shown that said pistol holding member 1 has two side plates 21, 22 attached inside the pistol holding member 1, the combination of both forms the body of the pistol holding member, inside of side plate 21, there is a space 23 for the locking mechanism to be put in, while the another side plate 22 has a window opening 24. On the pistol holding member 1, there is an opening 14 corresponding to the window opening 24 formed on the side plate 22 and a second opening 15 is also formed in front of said opening 14 on the same side of the pistol holding member, the second opening 15 has a furrow 16 for composing a safety enhancement mechanism 200.

As shown in FIG. 2, the locking mechanism 100 is composed of a box 3, a guide block 4, a spring 5 and a braker 6; wherein, said guide block 4 is put into the box 3, the spring 5 is put under the guide block 4, so that the block 4 can move up and down within the box 3, a guiding groove 41 is formed on one side of the guide block 4, and on the guiding groove 41, a furrow 42 is formed for locking the braker 6 inside the guide block 4.

The top end of braker 6 is formed as a hook 61, the hook 61 extends to one side, and the hook is in curve shape; the bottom portion of said braker 6 is formed as an arc rotational part 62, the arc rotational part 62 has a pin hole 621, and the arc rotational part 62 is to unite with the guiding groove 41 of said guide block 4, by using a pin 63 to thoroughly insert into said pinhole 621, the braker 6 then can rotate in accordance to the groove 41 formed in said block 4; the bottom of said braker 6 has a raised strip 64, the said strip 64 has to unite with the furrow 42 formed on the groove 41 of said braker 6 so when the raised strip 64 and the furrow 42 is united, said braker 6 is fixed in the guide block 4. On the front side of said braker 6, a locking hole 65 is formed for the fixation of said braker 6, that is, a cover 66 is attached to said pistol holding member 1 by a screw 70 goes through the cover 66, the opening 14 of said pistol holding member 1 and window opening 24 of side plate 22, and then screws into the said locking hole 65; one side hole 67 is also formed on the stopper 6.

As shown again in FIG. 2, at the outer side of the pistol holding member 1 is a safety enhance mechanism 200, it consists of a button 71, a base board 72 and a pin 73 that is fixed to the front end of the base board 72, the function of this mechanism is to firmly lock in the locking mechanism 100 from any possible movement, this is achieved by mounting the base board 72 into the furrow 16 formed at the second opening 15 of said pistol holding member 1, and assembling button 71 onto the base board 72 through the said second opening 15. Thus when the button 71 is pushed forward, the fixed base board 72 and pin 73 will also be moved forward or back accordingly, once the pin 73 is inserted into the side hole 67 of said braker 6. It restricts the motion of said braker 6, so the locking mechanism 100 cannot be activated.

Figure 3:
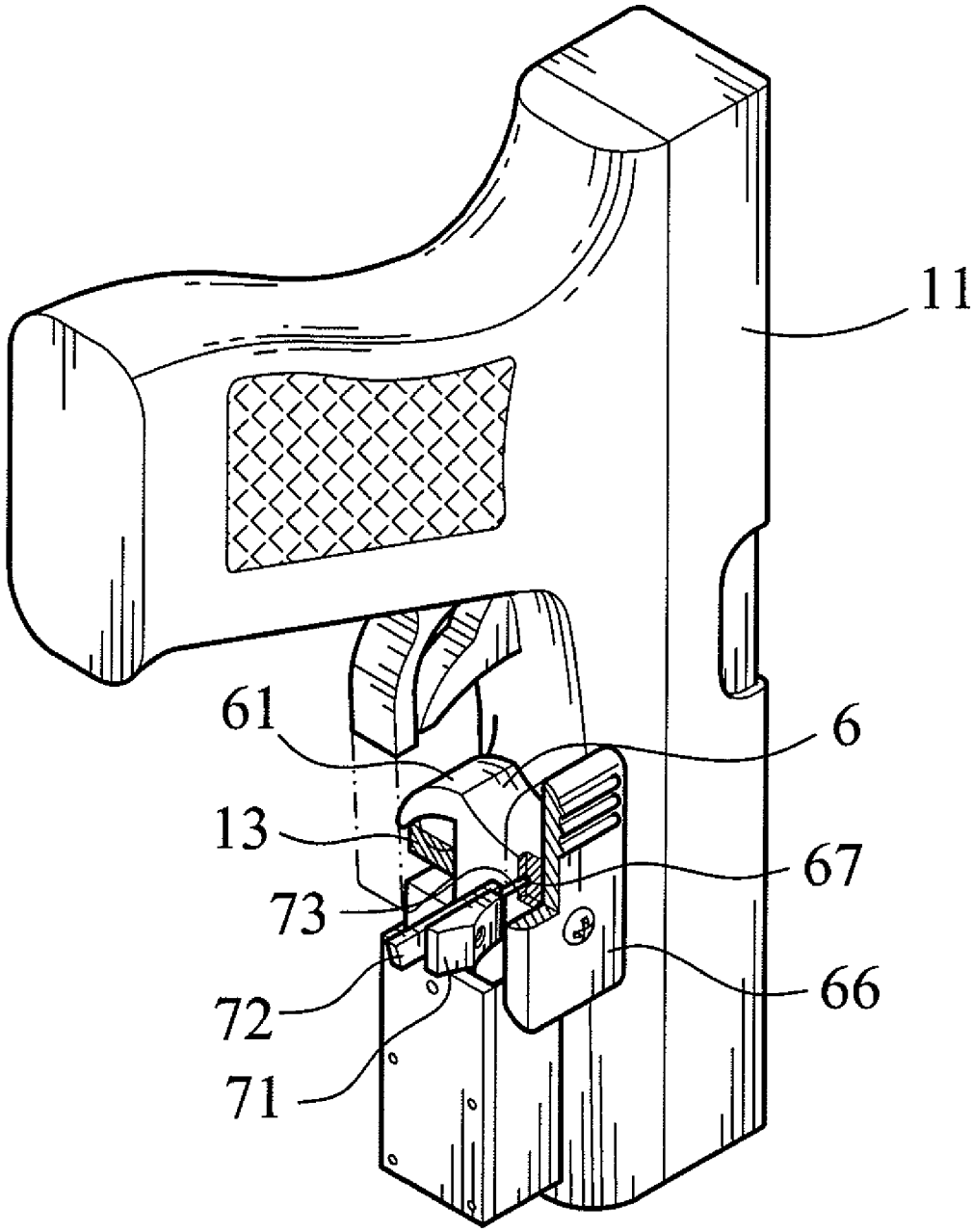
FIG. 3 is a three-dimensional view showing a pistol is put in the pistol holder of present invention.
Figure 4:
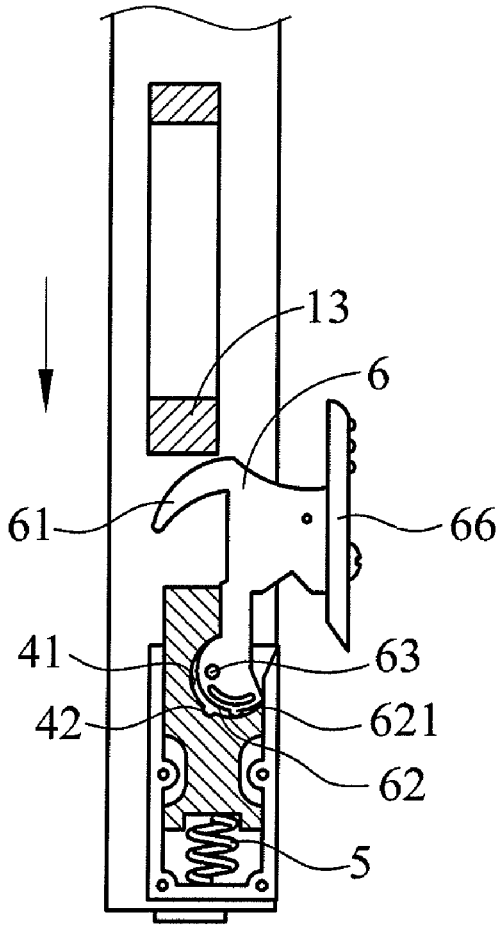
FIG. 4 is an illustrative view showing a pistol is putting in the pistol holder before the locking mechanism is activated.
Figure 5:
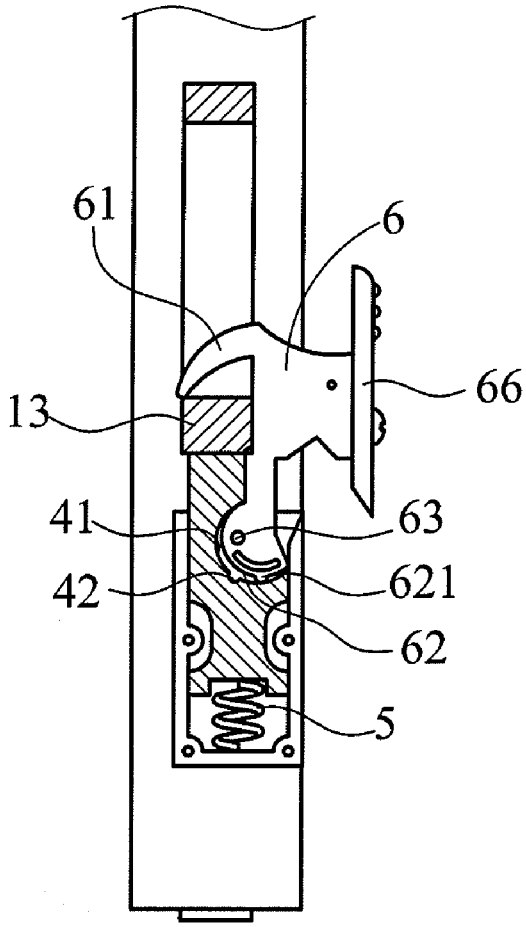
FIG. 5 is an illustrative view showing a pistol is kept in the pistol holder after the locking mechanism is activated.

After the above elements of mechanisms are assembled as shown in FIGS. 3, 4 and 5, if a pistol is put into the pistol holding member 1, the pistol will be secured in the pistol holder by following steps: the trigger holding frame 13 of pistol 11 is first pressed on the hook 61 of braker 6, while using the pin 63 as a rotation center, the braker turns outwardly in the groove 41 of guide block 4 and presses the guide block 4 move downward to make the spring 5 be in a depressed condition. When the trigger holding frame 13 passes through the hook 61 of the braker 6, the spring 5 at the bottom of guide block 4 then automatically pushes the guide block 4 move upward, then the hook 61 of braker 6 turns back into secure position, locks the trigger holding frame 13 of pistol 11, thus the pistol cannot be taken out of pistol holding member 1.

Figure 6:
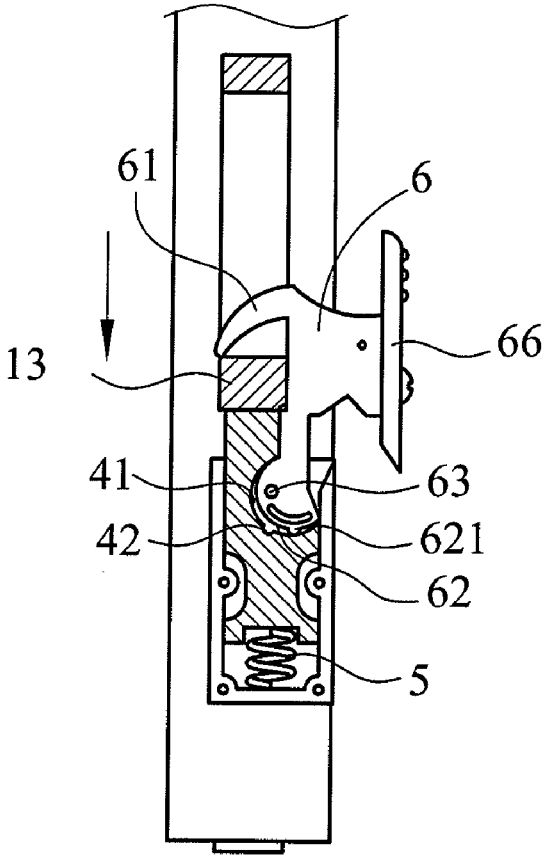
FIG. 6 is an illustrative view showing the trigger holder of pistol is not being pressed down in the pistol holder of present invention.
Figure 7:
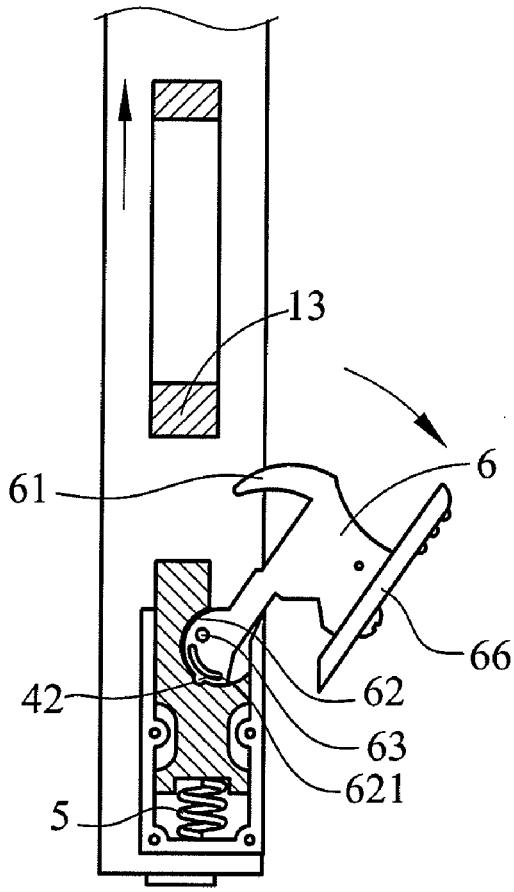
FIG. 7 is an illustrative view showing the trigger holder of pistol is being pressed down to open the locking mechanism of present invention.

In order to pull out the pistol, as shown in FIGS. 6 and 7, the user must first press down the pistol to make the trigger holding frame 13 push the guide block 4 move downwardly, when the guide block is moving downward, the end portion 411 of the arc guiding groove 41 pushes the rotational part 62 of said braker 6, then the rotational part 62 rotates along the guiding groove 41, and when the raised strip 64 of braker 6 falls into the furrow 42 of said guiding groove 41, the braker 6 is locked in the position for pistol to be taken out.

Figure 8:
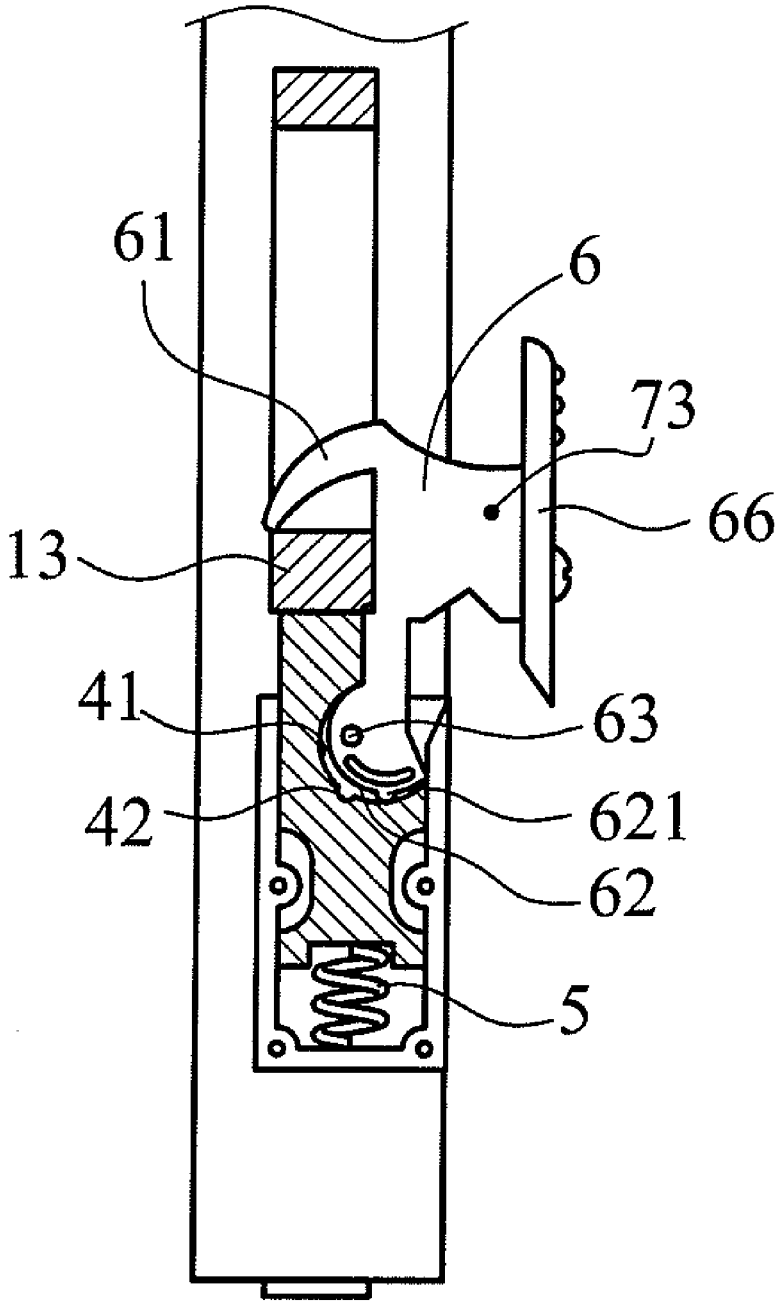
FIG. 8 is an illustrative view showing the locking mechanism is securely locked by a safety enhancement mechanism of present invention.
Figure 9:
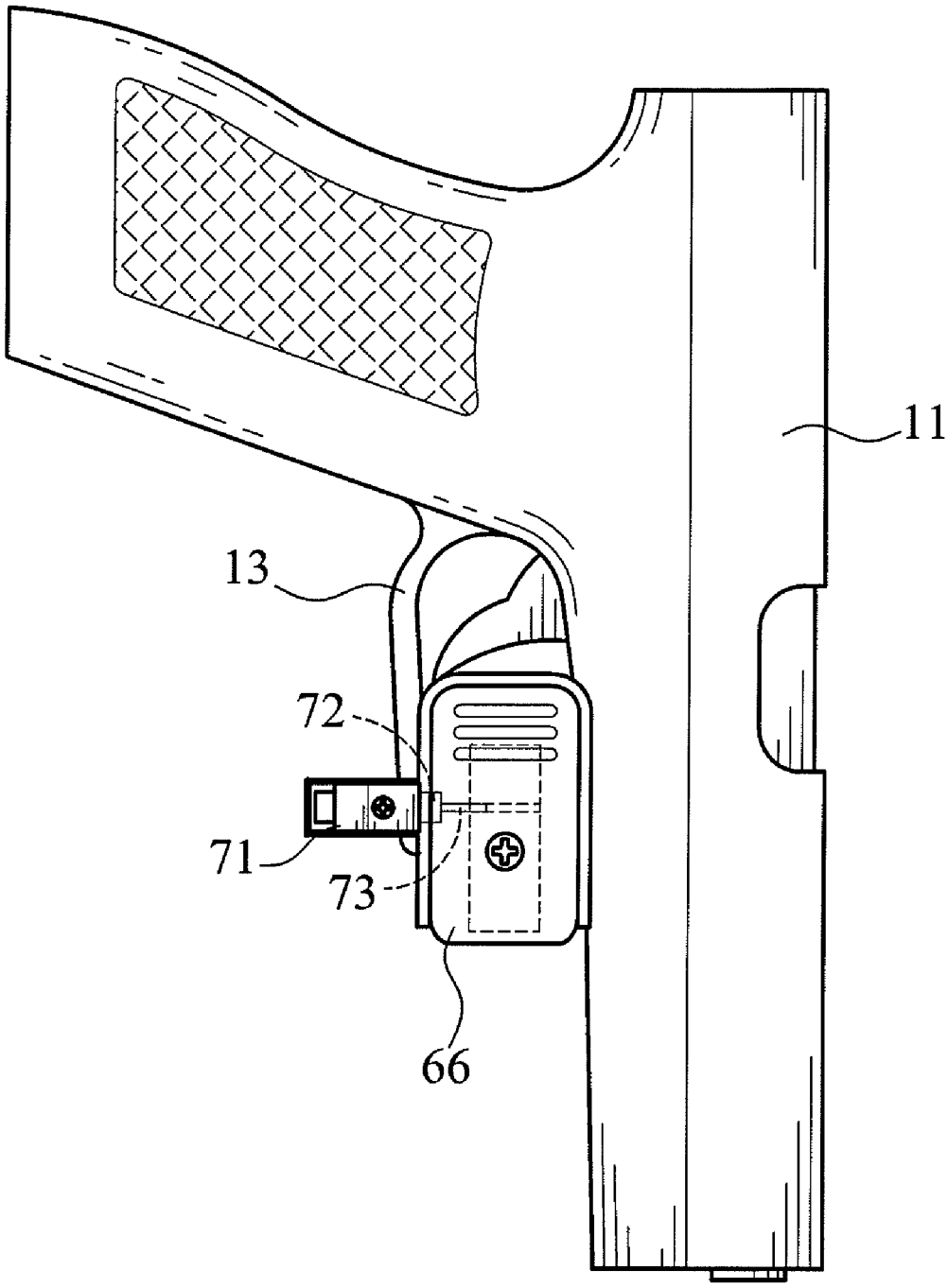
FIG. 9 is a two-dimensional view showing the locking mechanism is being securely locked in closed position by the safety enhancement mechanism of present invention.

As shown in FIGS. 8 and 9, when the locking mechanism 100 of the present invention locks the pistol 11, the pistol would not be taken out easily. In addition, by the security enhanced mechanism 200, said button 71 can be pushed and then the pin 73 at the front end of base board 72 is inserted into the hole 67 formed in the braker 6, so the braker 6 is locked in secure closing position, the double security for the pistol holder is then obtained.

In conclusion from above, we can see that by a locking mechanism and a safety enhanced mechanism for pistol installed in the pistol holder, the pistol must be pressed down to deactivate the security mechanism to pull out, and the locking mechanism can be locked by said safety enhanced mechanism, the present invention can improve the disadvantageous occurred in conventional one, it possesses uniqueness and progressiveness. Furthermore, since present invention has not been publicized, it meets the requirement of approvable patent.

Although the present invention has been described with a certain degree of particularity, the present disclosure has been made by way of example and changes in details of structure may be made without departing from the spirit thereof.

What is claimed is:

1. A safety enhanced pistol holder, inside the pistol holder, a space is formed holding a locking mechanism, said locking mechanism consists of:

a box;

a guide block, which is put inside said box, a guiding groove is formed on one side of the guide block, and a furrow is formed on said guiding groove;

a spring, which is fixed at the bottom of the said guide block;

a braker, which has a hook formed at the top, and its bottom is formed as an arc rotational part to be united with the guiding groove of said guide block by a pin to penetrate a pin hole formed on the braker, so as to enable the braker rotate in the guiding groove of the guide block; there is also a strip formed at the bottom of the braker, said strip falls and fit into said furrow formed on the guiding groove of said guide block;

by the above construction, when a pistol is put into the pistol holder, the pistol is locked automatically by the hook of said braker, and when the pistol is pressed downward, it causes the strip at the bottom of the braker to fall and fixed into the furrow of the guiding groove of said guide block, the pistol then can be pulled out of pistol holder.

2. The pistol holder as claimed in claim 1, wherein said braker has a pinhole formed at its side wall for locking the braker by a safety enhanced mechanism.

3. The pistol holder as claimed in claim 2, wherein said safety enhanced mechanism is fixed on the outer side of the pistol holder, it is equipped with a pin that is inserted into said pinhole of said braker.

4. The pistol holder as claimed in claim 3, wherein said safety enhanced mechanism is comprised of a base board to which a pin is fixed, and attached to the base board is a button that can be moved forward and backward into position of locking or unlocking the braker of said locking mechanism.

* * * * *